United States Patent [19]

Dornbusch

[11] 4,387,808

[45] Jun. 14, 1983

[54] SHIPPING DEVICE

[75] Inventor: Arthur H. Dornbusch, Cincinnati, Ohio

[73] Assignee: The Procter & Gamble Company, Cincinnati, Ohio

[21] Appl. No.: 262,721

[22] Filed: May 11, 1981

[51] Int. Cl.[3] ..... B65D 81/00; B65D 85/62

[52] U.S. Cl. ..... 206/432; 206/45.33; 206/460; 206/497; 206/594; 229/DIG. 12; 264/46.8

[58] Field of Search ..... 206/427, 433, 432, , 206/594, 597, 523, 524, 45.33; 264/46.8, 45.7; 229/DIG. 12

[56] References Cited

U.S. PATENT DOCUMENTS

| | | | |
|---|---|---|---|
| 2,216,339 | 10/1940 | De Reamer | 206/433 |
| 2,260,424 | 10/1941 | Waters | 206/433 |
| 3,222,843 | 12/1965 | Schneider | 53/27 |
| 3,384,229 | 5/1968 | Kaschyk et al. | 206/432 |
| 3,478,869 | 11/1969 | Walters | 206/597 |
| 3,590,989 | 7/1971 | Wittwer | 206/47 |
| 3,734,280 | 5/1973 | Amneus et al. | 206/431 |
| 3,870,741 | 3/1975 | Kuhn | 264/46.4 |
| 3,994,115 | 11/1976 | Mako et al. | 53/29 |
| 4,136,141 | 1/1979 | Bauer et al. | 264/45.2 |

*Primary Examiner*—William T. Dixson, Jr.

*Attorney, Agent, or Firm*—John V. Gorman; Richard C. Witte; Thomas H. O'Flaherty

[57] ABSTRACT

A plastic shipping and display package and a method of making the shipping and display package are disclosed for use in packaging an array of articles in closely spaced relation. The shipping package includes a layer of thermoplastic polymeric material that forms a molded-in-place tray resting on a lower article-contacting surface. The tray has support pockets for the article to be shipped, the pockets being formed by placing the articles in the polymeric material while it is still moldable and allowing the material to set. An upper article-contacting surface prevents vertical movement of the articles and, in conjunction with the tray, movement by the articles within the shipping package is virtually eliminated. The article-contacting surfaces can be the end closures of a corrugated container or formed from flat, structurally rigid materials that can be enclosed in some outer overwrap, such as a shrinkwrap, to envelope the array of articles.

9 Claims, 9 Drawing Figures

Fig. 3
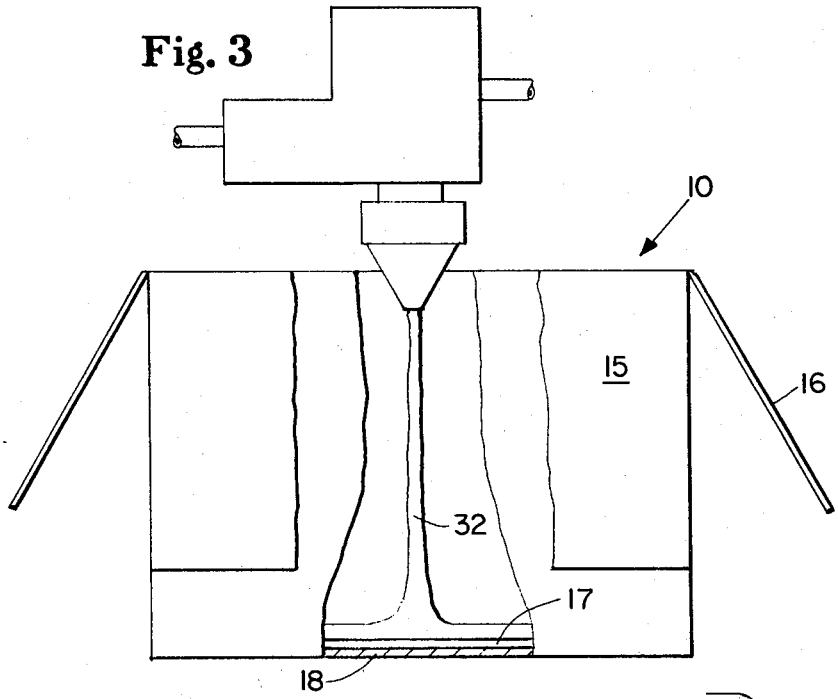
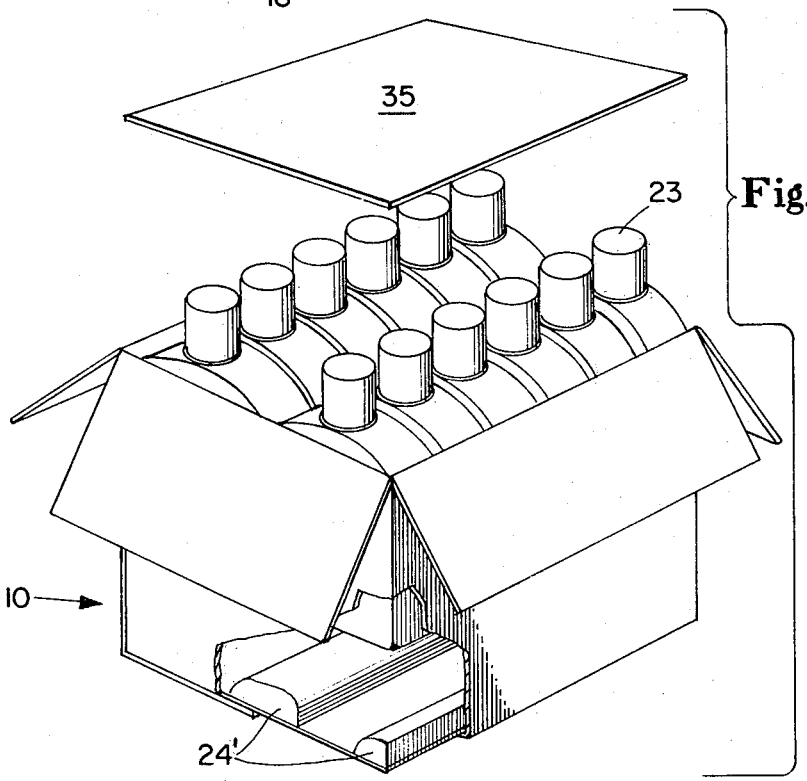
Fig. 4

SHIPPING DEVICE

TECHNICAL FIELD

The present invention relates to a shipping device for use in conjunction with shipping packages such as corrugated containers, shrinkwrap or the like to support and separate an array of articles to be shipped.

In particular, the present invention relates to the use of a thermoplastic polymeric material to form a molded-in-place plastic tray or strips having pockets therein which are formed by and maintain the lateral positions of the articles to be shipped.

BACKGROUND ART

The use of thermoplastic polymeric material to package articles, primarily individual articles, is old in the art. The conventional method of packaging articles in a thermoplastic polymeric material is to place the article to be packaged or protected in spaced relation to the walls of an outer shipping container such as a corrugated container, fill the entire void volume between the article and the container walls with the thermoplastic polymeric material and then allow the material sufficient time to cure and set. To retrieve the encapsulated article after shipment normally required the destruction of the envelope of formed thermoplastic material. In any case, there was little if any attempt to reuse the material and so the conventional method involved considerable cost in terms of material as well as waste and was useful only to protect costly and easily damaged articles.

For example, U.S. Pat. No. 4,136,141 issued to U. Bauer et al. discloses a method for packaging an article to be shipped comprising an outer container into which the article is placed in spaced relation to the walls of the container. A flexible envelope is placed around the article and is then filled with a foamed cellular plastic material which sets up around the article to protect it.

To reuse the plastic material one could make use of the teachings in U.S. Pat. No. 3,222,843 issued to M. Schneider. In the Schneider patent, the article to be packaged or protected is placed in spaced relation to the walls of an outer shipping container and is spaced from the bottom wall by means of a pre-cut support. The remaining space between the article and the container walls is filled with foamed material that is poured into a pair of oppositely disposed flexible bags. The foamed material fills the bags and pushes the walls of the bags up against the article and the outer container in order to take the shape of the article to be shipped when the foamed material sets upon cooling. The resulting package can be easily reused since the two flexible bags are now filled with a formed thermoplastic material that is shaped to fit around the article to be shipped and any other articles of that same shape.

A method and apparatus for forming a protective packaging similar to that disclosed in U. Bauer et al. and M. Schneider, supra is disclosed in Windecker, U.S. Pat. No. 3,666,850 in which an apparatus delivers heat expandable thermoplastic materials to surround an article to be shipped, and at the same time heats the thermoplastic material such that they expand and adhere together and form a solid body around the article.

Another reusable shipping device is disclosed in U.S. Pat. No. 3,590,939, issued to J. C. Wittwer showing a protective bottle display and shipping container that is molded around an article to be shipped and can be reused in shipping that article or one of a similar shape. Wittwer discloses a clear plastic container that is molded over a shape that is similar to the article to be shipped and then has the shape removed, leaving the empty space. The article to be shipped is then placed in the container and a bottom element is secured over the opening to retain the article in the container. The outer walls of the container are spaced away from the article such that any impact or shock experienced during shipment can be absorbed in these outer walls and thereby prevent damage to the article.

There are also a number of patents directed to a means for opening a formed plastic package made from thermoplastic material in order to extract the article shipped. Obviously, the package formed according to the method disclosed in Schneider does not require any additional device to open it. However, for a molded plastic protective package formed according to the teachings of Windecker, or Bauer et al., supra, U.S. Pat. No. 3,870,741 issued to G. B Kuhn discloses a method for making a foam package that includes a tear strip to facilitate removal of the article to be shipped.

All of the above-described methods for packaging are, practically speaking, limited in application for use with delicate and expensive items which can better bear the inordinate cost. Thus, while the protective qualities of packages employing the technology of forming molded-in-place supports for articles to be shipped might be beneficial in connection with less expensive items, heretofore the cost has been prohibitive.

In addition, the cost of shipping is such that most inexpensive items need to be shipped in groups as they could not be economically packaged individually. Therefore, a manufacturer will usually provide protection for the articles from ordinary shipping damage and also from damage caused by mutual contact, i.e., abrasion, denting, breakage. The most widely used of such protective devices are container inserts such as dividers, perimeter pads and the like. However, the use of dividers and perimeter pads is also costly in that they require additional materials and complex equipment for assembly, set-up and handling of the articles to be shipped.

Therefore, it is an object of this invention to provide, at minimal cost, a package for an array of articles to be shipped in which the articles are supported and separated without the use of dividers, perimeter pads or the like and yet protected from many common causes of damage that occur during shipment.

Another object of the invention is to provide a novel method for packaging an array of articles to be shipped in containers, boxes or similar shipping devices, by using a foamed-in-place polymeric material.

Yet another object of the invention is to provide a reusable, molded tray associated with the container, box or similar shipping package to provide support and separation of an array of articles to be shipped.

Still another object of the invention is to provide cut case protection for the articles to be shipped and to provide a tray that can be used for display purposes.

Still another object of the present invention is to provide a method which ensures a satisfactory packaging means for an array of articles of any size or shape.

DISCLOSURE OF THE INVENTION

This invention provides for a shipping package and a method for packaging an array of articles. The shipping package includes an array of identical articles to be shipped in a set spatial relationship with one another, upper and lower article-contacting surfaces separated by the approximate height of the articles, a layer of thermoplastic material supported by the lower article contacting surface and having a thickness in the range of from about ⅛" to about ½", and pockets formed in the layer of thermoplastic material to the shape of the lower portions of the articles and designed to maintain the relationship of all the articles in the array. The pockets are located in positions which correspond with at least certain of the articles in the array and have the lower portions of such articles resting therein.

The method of packaging an array of articles includes placing the lower article-contacting surface of a package in a generally horizontal position; pouring a relatively thin layer of moldable thermoplastic material, that is incapable of firmly bonding to the articles when set, onto the upper surface of the lower article contacting surface; forming an array of the articles to be packaged such that the articles in the array are maintained in a generally planar, predetermined relationship with one another; lowering the array of articles into the moldable thermoplastic material while the material is still moldable whereby the articles sink into the thermoplastic material and come to rest substantially on the inner surface of the lower article contacting surface; allowing the moldable thermoplastic material to set, thereby creating pockets around the articles precisely conforming to the shape and locations of the articles in the array; and placing an upper contacting surface in overlying contact with the array. The package is then sealed whereby the upper article contacting surface in conjunction with the pockets securely hold the articles in place in the array.

BRIEF DESCRIPTION OF THE DRAWINGS

Further objects and advantages of the invention will become apparent from the following description and claims, and from the accompanying drawings, wherein:

FIG. 3 is a side elevational view, partially broken away, of a shipping container into which thermoplastic polymeric material is being deposited in accordance with the present invention.

FIG. 4 is a perspective view, partially broken away, of an alternative embodiment of the present invention and in which an array of bottles is being introduced into a shipping container having a layer of thermoplastic polymeric material applied in a series of strips.

DETAILED DESCRIPTION OF THE INVENTION

Figure 1:
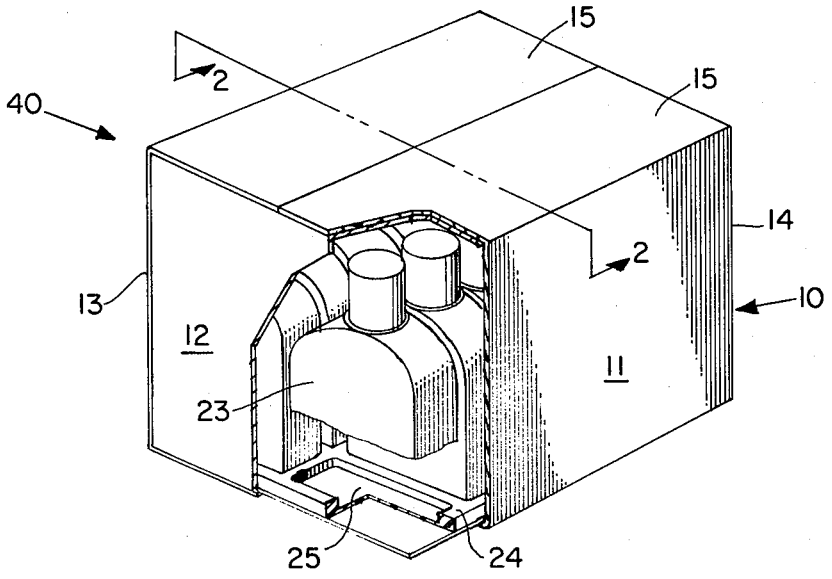
FIG. 1 is a perspective view, partially broken away, of one embodiment of the present invention in which a shipping container is used.

Referring now to the drawings in detail, wherein like numerals indicate like elements throughout the several views, the present invention can be employed in a number of alternative shipping packages. The shipping package in its basic form includes a layer of thermoplastic polymeric material molded-in-place in the form of a tray. The tray is adhered to the lower article contacting surface of the package and includes support pockets for the articles to be shipped, the pockets being formed by placing the articles into the polymeric material while it is still moldable and allowing the material to cure and set. The shipping package also includes an outer structural member which encloses the articles and the tray in which they are disposed between an upper and a lower article contacting and supporting surface such that movement by the articles within the shipping package is virtually eliminated.

Figure 4A:
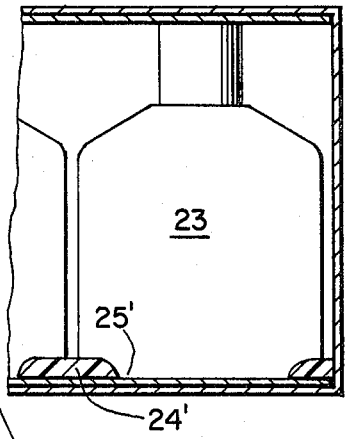
FIG. 4A is an enlarged fragmentary view of the embodiment in FIG. 4, showing the pocket formed by a bottle placed on the strips of polymeric material.
Figure 5:
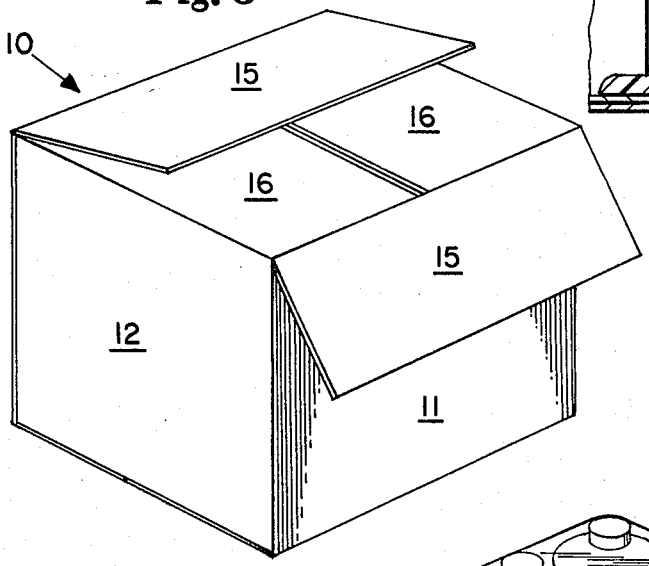
FIG. 5 is a perspective view of the shipping container of FIG. 4 during closure of the container.
Figure 6:
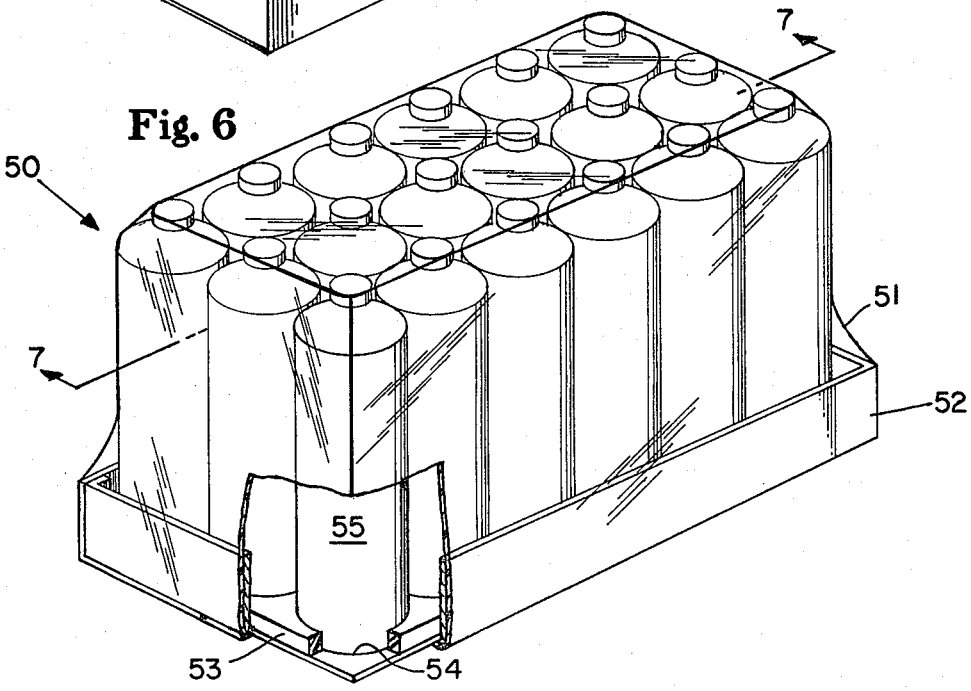
FIG. 6 is a perspective view, partially broken away, of another alternative embodiment of the present invention in which a shrink wrap envelope is used.
Figure 7:
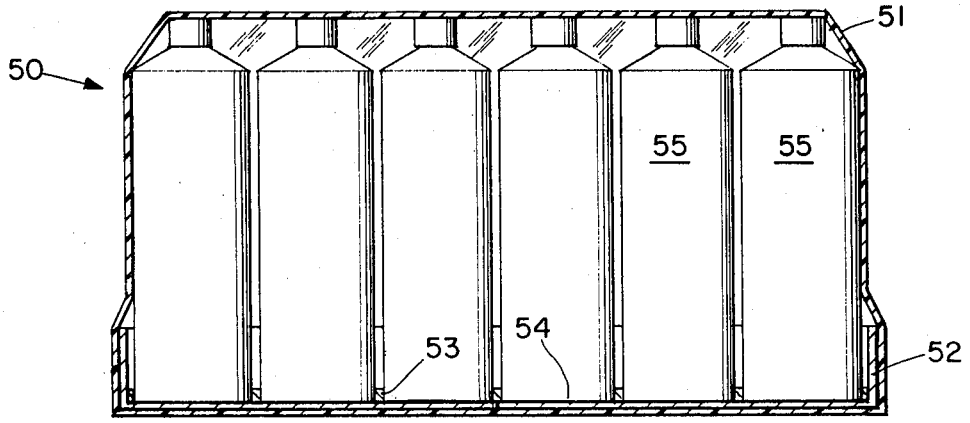
FIG. 7 is a vertical sectional view of the shrink wrap package of FIG. 6, taken along line 7—7.
Figure 8:
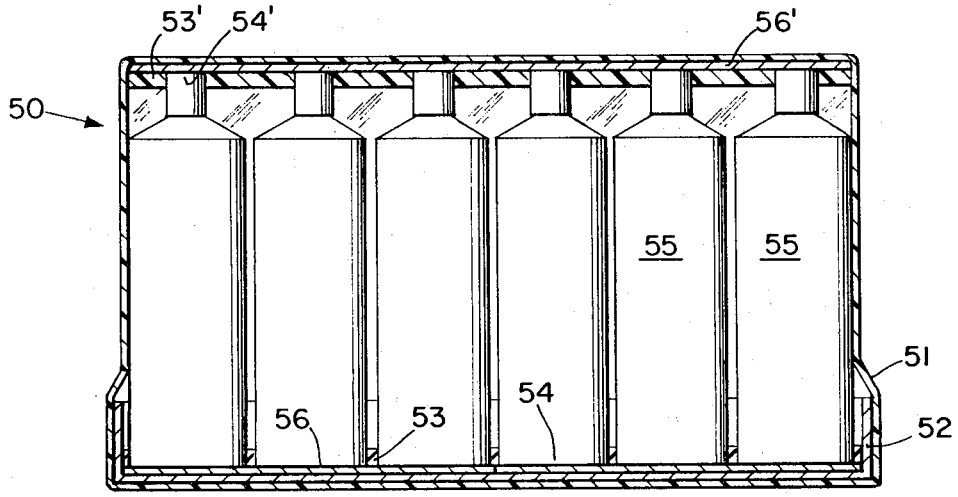
FIG. 8 is a vertical sectional view of an alternative shrink wrap package in which the thermoplastic polymeric material is utilized to support the top as well as the bottom surfaces of the bottles.

One exemplary embodiment of the present invention is shipping package 40, shown in FIGS. 1–5, which is formed by erecting a container 10, depositing or pouring the moldable thermoplastic material 32 into the container 10 as desired, as shown in FIG. 3, forming an array of articles 23 in mutually spaced relationship, placing the array of articles 23 into the material 32 to form the pockets 25 or 25', shown in FIG. 1 or 4*a*, respectively, allowing the polymeric material to set, and then closing the container, as shown in FIG. 5. An alternative shipping package 50, shown in FIGS. 6–8, is formed in essentially the same way as shipping package 40 except that a shrink or stretch wrap envelope 51 is placed around the container 52, tray 53 and bottles 55 in a conventional manner.

Figure 2:
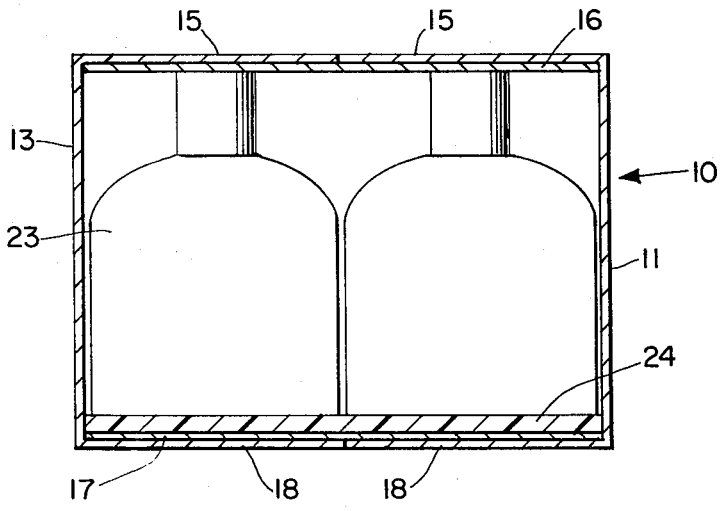
FIG. 2 is a vertical sectional view of the shipping container of FIG. 1, taken along line 2—2.

The shipping package 40, shown in FIGS. 1–5, includes a container 10 which can be formed of any suitable material such as paper, cardboard, wood, metal or the like. The container 10 comprises side walls 11 and 13, end walls 12 and 14, outer top closure flaps 15 and inner top closure flaps 16, and inner bottom closure flaps 17 and outer bottom closure flaps 18, all in a conventional arrangement. FIGS. 1 and 2 show the final shipping package 40 made in accordance with the invention and includes the container 10, a layer of moldable polymeric material forming a plastic tray 24 having support pockets 25 and the array of articles 23 to be shipped, bottles, supported in the pockets 25. The articles 23 within the array can be touching or, alternatively, and as shown in the drawings, are spaced from one another and, preferably, from the side and end walls 11–13 of container 10 by a finite distance. For commercial purposes where such protection is necessary, spacing in the range of from about 1/16 to about ⅛ is preferred between articles and from about 1/16" to about 5/32" between the articles 23 and the side or end walls 11 and 13.

In a preferred embodiment a standard corrugated container is used that is modified to provide a substantially complete, flat bottom surface formed by the inner bottom flaps 17 so that the bottom surfaces of the bottles will be in the same plane, and a substantially complete inner top surface formed by the inner top flaps 16 so that the container, when closed, securely holds the top surfaces of the bottles in the same plane and holds the bottles tightly in the tray 24. Both the inner top flaps 16 and the inner bottom flaps 17 are sized in width (from the distal end to the hinge line with the associated side wall) to be just slightly less, approximately $\frac{1}{8}''$ to $\frac{1}{4}''$, than half the length of either of the side walls 11 and 13. Alternatively, instead of modifying the standard corrugated container one could merely reverse the order of folding the closure flaps, i.e. fold the outer top flaps 15 and the outer bottom flaps 18 first and thereby provide a substantially complete top and bottom surface since these flaps are normally sized in width to be equal to approximately one half the end walls 12 and 14. Also, one could provide a flat bottom surface and also a flat top surface by adding a liner, such as liner 35 shown in FIG. 4.

Referring again to FIG. 1, the layer of polymeric material forming the tray 24 is a continuous mass in the embodiment of FIG. 1 such that the articles to be shipped can be placed into the moldable polymeric material in any pattern and yet still be adequately supported. An alternative and preferred embodiment is shown in FIGS. 4 and 4A, wherein the polymeric material is applied in strips and forms a discontinuous plastic tray 24'. In this latter embodiment the moldable polymeric material is applied only where necessary to adequately support and space the articles to be shipped as desired. This latter embodiment therefore uses only the minimum essential material to form the tray 24'.

As indicated, the present invention could also be used in packaging the articles to be shipped in a shrink or stretch wrap envelope. The shipping package 50, shown in FIGS. 6–8, includes an array of bottles which are packaged in a shrink or stretch wrap envelope employed in a conventional manner. FIGS. 6 and 7 show the final shipping package 50 that includes the container 52, the layer of polymeric material forming the plastic tray 53 and the array of bottles 55 in pockets 54. Again, as in the embodiment of FIG. 1, a standard container is modified to provide for a flat bottom surface so that the bottles will all be in a uniform plane. However, it is not as critical in a shrink or stretch wrap envelope to provide a flat bottom surface since the shrink-wrap envelope is heat-shrunk and the stretch wrap is pulled tightly around the articles to be shipped for closure and can accommodate the irregular top surface that would result if there was not a flat bottom surface while still holding the bottles securely in the tray. As with the container 10, FIG. 1, the flat bottom surface of shipping package 50 could be formed by employing a liner, such as liner 35 shown in FIG. 4. For example, the embodiment of shipping package 50 shown in FIG. 8 has a liner 56 on the inner bottom of container 52. It is also acceptable when using shrink or stretch wrap envelopes to use a liner, alone, on either the bottom or on the top and bottom of the package and eliminate the container 52.

Both the shrink or stretch wrap envelope package 50 shown in FIGS. 6–8 or the container package 40, shown in FIGS. 1–5 can be modified if necessary to adequately support an irregularly shaped or rounded article by providing a layer of polymeric material to form tray 53' on the top of the package as well as layer 53 on the bottom of the package, as shown in FIG. 8. FIG. 8 is identical to FIG. 7 except for the addition of a liner 56' at the top having a tray 53' and pockets 54' formed by the top surfaces of the bottles 55. A similar liner and tray could be used in the container package 40. Most articles can be adequately supported by providing only one layer of polymeric material, i.e. one tray. However, some irregularly shaped articles may be preferably supported on both their top and bottom surfaces.

The plastic tray in any of the above-described embodiments is formed-in-place in the container or on the liner by introducing a relatively thin layer of a moldable, thermoplastic polymeric material onto the lower article contacting surface, e.g., the bottom of the container or on the top surface of the liner that is positioned in the bottom of the container. The polymeric material must be capable of bonding to the container 10 but should not bond, following setting, to the articles 23 to be shipped. The array of articles 23 to be shipped is then placed into the polymeric material while it is still moldable and the material is allowed to cure and set around the portion of the articles disposed therein. The tray thus formed on the lower article contacting surface has pockets precisely shaped and spaced by the array of articles to be shipped. In addition, if one wishes to have a tray formed on the upper article contacting surface, e.g., the bottom surface of the liner, thermoplastic material is placed onto the liner and then the liner is turned upside-down and placed onto the array of articles 23.

The polymeric material that is employed in the invention to form the plastic tray can include a large number of moldable, thermoplastic materials. For example, one such class of material, commonly referred to as hot melt adhesives, is capable of bonding readily to relatively porous surfaces such as corrugated container board and yet can be formulated to be incapable of establishing an effective bond with articles to be shipped that are manufactured from relatively nonporous surfaces such as plastic or glass. It should be noted that there are many hot melt adhesives, not to mention an equally large number of cold glues, available for a wide variety of service conditions. Therefore, in practicing the invention, one of ordinary skill will be required to select from the large number of usable moldable polymeric materials so as to accommodate the specific characteristics and shipping needs of the articles to be shipped as well as the type of material that is to be used to construct the container or liner used in the shipping package.

Generally, the polymeric material chosen must be formulated so that it will not damage or distort either the articles to be shipped or the shipping container that will be used. The polymeric material must be formulated so that when it sets it does not firmly adhere to the articles to be shipped. For the purpose of production packaging lines the material should have an open time, i.e., it should remain compressible and moldable, for from 1 to 5 minutes after it is introduced into the container, depending on the speed of the packaging equipment being used, to allow sufficient time for the articles to be shipped to be introduced into the container and into the polymeric material and form the pockets. For most applications it is desirable for the polymeric material to be able to adhere or bond to the material of construction of the shipping container. It is possible by a judicious selection of the polymeric material and the material of construction of the container or liner to provide for no bonding between the polymeric material and the container. However, by assuring that the polymeric material adheres to the container one can use the polymeric material in such a way that the material is applied only where necessary to adequately support the articles and therefore only a minimum of polymeric material is used. For example, the polymeric material can be applied in strips corresponding to the rows of the array of articles to be shipped, as shown in FIGS. 4 and 4A, or it can be applied in a grid-like fashion corresponding to the arrangement of the individual articles.

In these embodiments shown in FIGS. 4 and 4A, the application of polymeric material is such as to provide the necessary support and separation for the articles with the least amount of material used. One of ordinary skill in the art could determine an appropriate pattern of application for the polymeric material to support the particular articles to be shipped.

It is also possible to apply the moldable polymeric material in such a way that additional benefits can be achieved. For example, by applying a bead of material around the inside perimeter of the bottom of the container one could provide a measure of cut case protection for the articles. The bead of material would serve to space the bottles away from the sides of the container and also to provide a surface against which to cut. A pre-printed cut line on the outer surface of the container could guide the person opening the container. Alternatively, the bottles could be simply positioned away from the container walls with the tray container being formed of strips that support the bottles at that position.

The polymeric material can be applied by a variety of apparatus depending on the specific characteristics of the polymeric material to be used and the type of container and type of article to be packaged and supported. There is a large body of technology developed for the application of the wide variety of moldable, thermoplastic, polymeric materials. Hot melts, for example, can be applied by nozzle extruder applicators, hand guns, intaglio print wheel applicators, wide reverse roll coaters, slot coaters with fixed-slot dimensions or adjustable-slot dimensions, dauber applicators and screw extruder applicators. It should be noted that for a specific polymeric material there are usually several preferred methods of application and preferred apparatus known to one of ordinary skill in the art.

For the purpose of this invention, a preferred material is a hot melt adhesive formulated to adhere to standard corrugated container board and yet not adhere to plastic or glass. Specifically, the preferred embodiment uses corrugated board for the container. The corrugated board is a standard "C" flute corrugated available generally from corrugated suppliers. An exemplary article to be shipped is a plastic bottle manufactured from polyethylene terepthalate (PET) polymer.

The hot melt adhesive is a thermoplastic rubber compound comprising a styrene, ethylene, butylene, styrene block copolymer that is available from Shell Chemical Company, One Shell Plaza, Houston, Tex. 77002 under the brand name Kraton. The Kraton polymer is then converted to a hot melt by Findley Adhesives, Inc., of 605 N. Wayne Ave., Cincinnati, Ohio 45215 in a proprietary process in which plasticisers and extenders are added to form a final hot melt adhesive compound. The Findley hot melt is formulated so that there is only minimal thermal shrinkage after application, in this instance less than 5%, to ensure that the pockets formed in the tray are tight enough to substantially eliminate movement by the bottles. It should be noted that any thermoplastic polymeric material used in carrying out the present invention should be formulated so that there is only minimal thermal shrinkage after application to thereby ensure that the pockets that are formed are sufficiently tight to substantially eliminate movement by the bottles. The hot melt is available from Findley under stock number X997-371-01 and is capable of bonding to the above-described corrugated board and not binding to the PET material of the bottles.

The hot melt compound supplied by Findley is preferably applied to the inner surface of the bottom of a container 10, as shown in FIG. 3, by means of Nordson Corporation's Hot Melt Thermoplastic Adhesive Foam System as described in U.S. Pat. No. 4,059,466 which issued to C. H. Scholl et al. on Nov. 22, 1977, which patent is hereby incorporated by reference. The equipment designed to foam hot melt as described in U.S. Pat. No. 4,059,466 is called Foam Melt and is available from Nordson Corporation, Packaging and Assembly Division, 350 Research Ct., Technology Park/Atlanta, Norcross, Ga. 30092. The Foam Melt equipment is essentially the same as standard hot melt application equipment manufactured by Nordson Corporation except for the addition of hardware to introduce and meter the inert gas that is used to foam the hot melt and the use of a double stage gear pump.

Standard Nordson hot melt extrusion nozzles are available to apply the foamed hot melt into the container. The application system can be designed with these nozzles to apply Findley's hot melt compound in any desirable pattern simply by adjusting the number of nozzles used and the position of the nozzles.

In one preferred embodiment, the array of articles, the plastic bottles, includes three rows having four bottles per row. The bottles are positioned such that they are in touching contact. The foamed hot melt is applied along the entire length of the lower contacting surface in five strips $\frac{1}{4}''$ wide by $\frac{1}{4}''$ thick which correspond to the rows of bottles. The strips are spaced so that both of the outside rows of bottles will each rest between two strips such that there will be some hot melt to provide support to the outside edges of the two rows of bottles and such that there will be some hot melt to provide support to the front and back edges of the front and back bottles of the two outside rows. The fifth strip is positioned along the center line of the middle row of bottles and is also long enough to provide support to the front and back edges of the front and back bottles of the middle row. However, if the bottles cannot be in touching contact then six strips $\frac{1}{4}''$ wide by $\frac{1}{4}''$ thick would be desired, spaced so that there are two strips per bottle. The four strips that are positioned along the adjacent edges of the three rows of bottles could be merged somewhat so that there would be two larger strips of $\frac{1}{2}''$ wide by $\frac{1}{4}''$ thick. In order to minimize the amount of hot melt used it is usually preferred to apply the strips separately leaving a space between them.

A bottle manufactured from glass can also be packaged in the Findley hot melt. However, due to the added weight of the glass the strips used were approximately 4" long, $\frac{1}{2}''$ wide and $\frac{1}{2}''$ thick for the example described above. An alternative approach to accommodating the additional weight of the glass would be to change the hot melt formulation so that it would produce a more rigid tray after it cured and set. As indicated previously, the specific polymeric material should be selected on the basis of the characteristics of the articles, the material of the container or liner and the protection that is required for the articles during shipment.

Another exemplary polymeric material that can be used to advantage in accordance with this invention is a material supplied by Tanco Plastics Co., P.O. Box 1967, Furman Hall Court, Greenville, S.C. 29602. The Tanco Adhesives material, sold under the trademark Flexfoam, is a sprayable flexible foam. Flexfoam is a two component system that gives a rapid rise and set. One component is a water-based polymer emulsion such as EPA or SDR containing an acid function. The other component is a nonplasticizing oil containing a carbonate or a bicarbonate and also containing a material that rapidly absorbs water. The two components described above are mixed well (high shear) in equal parts for a period of 5–10 seconds during which time the foaming reaction will have already begun. At this point the foam can be applied to the container by a variety of methods such as pouring, extruding or spraying. After the foaming reaction is completed, approximately 15 to 30 seconds after initial mixing, the array of articles can be placed in the foam material to form the pockets. There is an "open time" of approximately 10–15 seconds after the foaming reaction is completed. The thermal shrinkage associated with the Tanco material is also minimal and the pockets formed therein are sufficiently tight to substantially eliminate movement of the bottles. The foaming reaction can be speeded up by using an extension heating source such as infrared or microwave radiation if it is desirable for the purpose of speeding production.

The Flexfoam material will adhere to the same standard "C" flute corrugated material described above and will not adhere to the PET material used for manufacturing the bottles packaged in the corrugated shipping container. The Flexfoam is applied similarly to the foamed hot melt requiring 5 strips of approximately 4" long and ¼" wide by ¼" thick if the bottles are assumed to be in touching contact.

The two exemplary materials described above, the Findley foamed hot melt and Tanco Adhesive's Flexfoam, are both quick curing and could also be applied to the bottom surface of a liner, as shown in FIG. 8, without fear of the polymeric material dripping onto the bottles. However, it should be noted that conventional unfoamed hot melts can be applied only on a horizontal surface since as developed in U.S. Pat. No. 4,059,466 they will run on a vertical surface and drip to a certain extent onto the bottom surface of a liner until they are somewhat cooled. At the point where they are sufficiently cooled to not drip the open time remaining in which to form a molded pocket may be too short or nonexistant depending on the hot melt formulation being used. Foamed hot melts generally, in contrast, can be applied to a vertical surface or the bottom of a horizontal member without any problems because it exhibits a greater degree of thixotropy as described in U.S. Pat. No. 4,059,466.

With respect to Tanco Adhesive's Flexfoam, the foaming reaction produces a certain amount of water that needs to be removed and in addition, the Flexfoam needs to be applied initially on a top, horizontal surface and allowed to completely react before turning it over for use as a top liner such as illustrated in FIG. 8.

After the polymeric material is placed on the inside bottom surface of the container in a molten form and the articles to be shipped are placed into the polymeric material, the outer shipping container 10, as shown in FIG. 1, of the shipping package 40 or the shrink or stretch-wrap 51 of shipping package 50, as shown in FIG. 6, can then be closed around the polymeric material with its formed pockets and the array of articles disposed in the pockets to complete the shipping package.

Having shown and described the preferred embodiment of the present invention, various improvements and modifications thereof will be readily apparent to those skilled in the art. Accordingly, the scope of the present invention should be considered in terms of the following claims and is understood not to be limited to the details of structure and operation shown in the specification and drawings.

I claim:

1. A shipping package comprising:

(a) an array of identical articles to be shipped in a set spacial relationship with one another;

(b) upper and lower article contacting surfaces separated by the approximate height of the articles;

(c) a discontinuous layer of foam thermoplastic material extending across and supported by said lower article contacting surface and comprising a pattern of spaced configurations corresponding to the arrangement of the articles in said array, said thermoplastic material having a thickness in the range of from about ⅛" to about ½"; and (d) pockets formed in said discontinuous layer of thermoplastic material to the shape of at least part of the lower portions of said articles and designed to maintain said relationship of all the articles of the array, the pockets being located in positions which correspond with at least certain of said articles in said array and having the lower portions of such articles resting therein;

(e) said thermoplastic material being firmly bonded to said lower article contacting surface, but not to said articles.

2. The shipping package of claim 1 in which said articles in said array are mutually spaced from one another and each of said articles rests in at least one pocket.

3. The shipping package of claim 1 in which the upper article contacting surface is the top closure of a corrugated shipping container and in which the lower article contacting surface is the bottom closure of said corrugated shipping container.

4. The shipping package of claim 1 in which the upper article contacting surface is the top wall of a shrink wrap envelope and in which the lower article contacting surface is a corrugated liner board.

5. The shipping package of claim 1 in which the upper article contacting surface is the top wall of a stretch wrap envelope and in which the lower article contacting surface is a corrugated liner board.

6. The shipping package of claim 1 in which said thermoplastic material is a foamed hot melt adhesive.

7. The shipping package of claim 1 including a second layer of moldable thermoplastic material adhered to said upper article contacting surface, said second layer of moldable thermoplastic material having a thickness range of from about ⅛" to about ½".

8. The shipping package of claim 7 in which said second layer of thermoplastic material is discontinuous and comprises a plurality of strips.

9. A method for packaging an array of articles comprising:

(a) placing the lower article-contacting surface of a package in a generally horizontal position;

(b) pouring a relatively thin, discontinuous layer of moldable foamed thermoplastic material in the form of spaced configurations onto the lower article contacting surface, said thermoplastic material being capable of bonding firmly to said lower article contacting surface but incapable of firmly bonding to said articles when set;

(c) forming an array of the articles to be packaged, the articles in said array being maintained in a generally planar predetermined relationship with one another;

(d) lowering said array of articles into said moldable thermoplastic material while said material is still moldable whereby said articles sink into said thermoplastic material and come to rest substantially on said lower article contacting surface;

(e) allowing said moldable thermoplastic material to set, thereby creating pockets around at least part of the lower portions of said articles precisely conforming to the shape and locations of said articles in said array;

(f) placing an upper article contacting surface in overlying contact with said array; and (g) sealing said package whereby said upper article contacting surface in conjunction with said pockets securely hold said articles in place in said array.

* * * * *

UNITED STATES PATENT OFFICE
CERTIFICATE OF CORRECTION

PATENT NO. : 4,387,808

DATED : Jun. 14, 1983

INVENTOR(S) : Arthur H. Dornbusch

It is certified that error appears in the above-identified patent and that said Letters Patent are hereby corrected as shown below:

Title page of patent:

[56] References Cited
U.S. PATENT DOCUMENTS

After the Wittwer reference citation add

--- 3,666,850 5/1972 Windecker ..... 264/45 ---

Signed and Sealed this

Sixth Day of September 1983

[SEAL]

*Attest:*

GERALD J. MOSSINGHOFF

*Attesting Officer*

*Commissioner of Patents and Trademarks*